United States Patent [19]

Marsh et al.

[11] 4,013,572

[45] Mar. 22, 1977

[54] HYBRID FIX SYSTEM INCORPORATING PHOTODEGRADABLE POLYMERS

[75] Inventors: Dana G. Marsh, Rochester; John M. Pochan, Webster, both of N.Y.

[73] Assignee: Xerox Corporation, Stamford, Conn.

[22] Filed: Oct. 7, 1974

[21] Appl. No.: 512,590

[52] U.S. Cl. ..... 252/62.1 P; 96/1 SD

[51] Int. Cl.[2] ..... G03G 9/00

[58] Field of Search ..... 96/35.1, 115 P, 1 R, 96/1 SD; 252/62.1

[56] References Cited

UNITED STATES PATENTS

| | | | |
|---|---|---|---|
| 3,196,032 | 7/1965 | Seymour | 252/62.1 P |
| 3,775,326 | 11/1973 | Westdale | 252/62.1 P |
| 3,788,994 | 1/1974 | Wellman et al. | 252/62.1 P |

*Primary Examiner*—David Klein
*Assistant Examiner*—John L. Goodrow
*Attorney, Agent, or Firm*—J. J. Ralabate

[57] ABSTRACT

A novel toner system is provided employing a photodegradable toner. These toners are photodegradable during the fixing step in electrophotographic processes when they are exposed to light and then pressure or in the opposite sequences. This system provides excellent fixing of toner images at lower energy levels than is found in composition fixing systems.

12 Claims, No Drawings

HYBRID FIX SYSTEM INCORPORATING PHOTODEGRADABLE POLYMERS

BACKGROUND OF THE INVENTION

This invention relates to electrostatography and more particularly to improved electrostatographic developing materials fixing systems and the use thereof.

In electrostatography, more specifically recited in U.S. Pat. No. 2,297,691, a uniform electrostatic charge is placed on a photoconductive insulating layer, selectively exposed, and the resulting latent electrostatic image is developed to provide a visible reproduction of an original by depositing on the image a finely divided electroscopic marking material referred to in the art as "toner". Toner is normally attracted to those areas of the layer which retain a charge thereby forming a toner image corresponding to the electrostatic latent image. The image so produced may be transferred to a support surface or otherwise processed. The image may then be permanently affixed to the support surface employing conventional fixing methods such as heating or application of a suitable solvent.

Toner alone or in combination with a suitable carrier and additives, where appropriate, may be applied employing a number of development techniques among which are cascade, more fully defined in U.S. Pat. No. 2,618,552 to E. N. Wise; magnetic brush, more fully defined in U.S. Pat. No. 2,874,063; powder cloud, more fully defined by Carlson in U.S. Pat. No. 2,221,776; or touch-down development, as disclosed by Gundlach in U.S. Pat. No. 3,166,432; among others.

When fixing the final image by application of heat, problems in adapting such a technique to high-speed machines in view of the energy required to raise the temperature of the toner to the desired level, charring or combustion, and specifically adapting toner materials to these parameters for use in high-speed electrostatographic copying machines has resulted in the requirement for additional complex machinery and process techniques. The development of an appropriate toner material which will fuse under high-speed machine conditions and avoid blocking or caking, process readily and exhibit the appropriate triboelectric properties under changes in the ambient humidity has become a rather critical and demanding art in and of itself. Other characteristics and properties that must be controlled or eliminated in a desirable toner include the effects of impaction on the triboelectric properties the abrasive nature of the toner, and bead sticking which is the adherence of carrier beads to a reusable photoconductor surface.

Toner particles are usually comprised of thermoplastic resins selected to have melting points significantly above any ambient temperature that might be encountered during electrostatic deposition. In addition to the developing powder or toner materials described in U.S. Pat. No. 2,297,691 a number of additional toner materials have been developed especially for use in the newer development techniques including the cascade development technique described above. Generally speaking, these new toner materials have comprised various improved resins mixed with different pigments such as carbon black and other colorants. Some examplary patents along this line include U.S. Pat. No. 2,659,670 to Copley which describes a toner resin as rosin modified phenyl formaldehyde, U.S. Pat. No. Re. 25,136 to Carlson which describes an electrostatographic toner employing a resin of polymerized styrene and U.S. Pat. No. 3,079,342 to Insalaco describing a plasticized copolymer resin in which the comonomers are styrene and a methacrylate selected from the group consisting of butyl, isobutyl, ethyl, propyl, and iso-propyl.

Generally, these toners have been prepared by thoroughly mixing a heat softened resin and a colorant to form a uniform dispersion as by blending these ingredients in a rubber mill or the like and then pulverizing this material after cooling to form it into small particles. These toners, though they result in excellent image reproductions, do exhibit some disadvantages such as a rather wide range of particle sizes and the ability of the colored resin to be sufficiently pliable for high-speed pulverizing which results in an even wider range of particle sizes during pulverization. Other requirements of electrostatographic developers or toners including the requirements that they be stable in storage, non-agglomerative, have the proper triboelectric properties for developing and have a low melting point for heat fusing are only compounded by the additional requirements imposed by this toner forming process. It is, therefore, found that some developer materials, such as those containing toner particles made from low molecular weight resins though possessing desirable properties such as proper triboelectric characteristics are unsuitable because they tend to cake, bridge, and agglomerate during handling and storage. Another significant problem in the case of conventional toners is the high energy requirements for heat fusing sources employed with these toners.

Electrostatographic developer materials which are pressure fixable have been considered in view of the above stated difficulties. However, it is found that the toner requirements for good machine performance tend to be diametrically opposed to the requirements for pressure fixing. That is, low toner impaction requires a high toner softening temperature and good mechanical strength while pressure fixing requires softening and viscous flow at room temperature. In addition, one of the problems with potential pressure fixable toners is the need to gently handle these materials prior to pressure fusion to paper or other suitable support medium so that these materials will not prefuse and cause impaction in the development chamber. Therefore, a balance must generally be made between a material which will pressure fix onto paper at low pressure but not yet impact in the development chamber. A major cause of such prefusion is the abrasive action of the tumbling carrier beads on the toner both in normal cascade development and magnetic brush development.

Electrostatographic toner materials which are capable of pressure fixing are desirable and advantageous since unencapsulated materials which undergo cold flow tend to form tacky images on the copy sheet which often offset to other adjacent sheets. Toner particles containing unencapsulated materials which undergo cold flow, tend to bridge, cake, and block during production and in the shipping container as well as in the electrostatographic imaging machine. Of course, the toner material should be capable of accepting a charge of the correct polarity such as when brought into rubbing contact with the surface of carrier materials in cascade, magnetic brush, or touch-down development systems. Further, it is found that some toner materials which possess many properties as aforementioned which wound ordinarily be desirable in electrostatographic toners dispense poorly and cannot be used in automatic copying and duplicating machines. Still other toners dispense well but form images which are characterized by low density, poor resolution, or high background. Still other toners are suitable for processes where electrostatic transfer is employed.

In addition to pressure fix systems, other systems of a so-called hybrid nature have been employed such as pressure-vapor fix system wherein both pressure and a solvent vapor are applied to accomplish fixing or other combinations of heat, pressure and solvent fixing. Because of the energy requirements associated with heat fusing and the handling of an environmental problem associated with vapor fusing there is a demonstrated need for improved toner fixing systems.

It is, therefore, an object of this invention to provide a toner fixing system which is devoid of the above noted deficiencies.

Another object of this invention is to provide a toner fixing system which employs substantially reduced energy levels.

Again another object of this invention is to provide a novel toner system.

Yet another object of this invention is to provide a toner which is stable at toner fusing conditions in high-speed copying and duplicating machines.

Still another object of this invention is to provide an impaction resistant toner material.

Again, another object of this invention is to provide a toner material which is resistant to smearing, agglomeration, and may be fused readily with less heat energy.

Yet still another object of this invention is to provide a toner which reduces mechanical abrasion of electrostatic imaging surfaces and is effective at low initial electrostatic surface potentials to provide dense toner images.

Again another object of this invention is to provide a toner which allows toner fixing at higher rates with less pressure.

These and other objects of the present invention are accomplished generally speaking by providing a photodegradable toner system. More specifically novel toner compositions are provided which comprise photodegradable polymers so that when employed in a xerographic process these toners may be applied to render a latent electrostatic image visible employing conventional techniques and thereafter be fixed employing a hybrid fixing system which utilizes the photodegradability of the toner material itself. The toner of the instant invention is, therefore, applied either by itself or in connection with a carrier in the form of a developer during the developing step in a conventional electrophotographic process. Thereafter it is fixed e.g., by exposure to activating radiation which degrades the photodegradable polymer relieving the stress on the polymer and thereby allowing it to become affixed to the substrate on which it is deposited, followed by the application of pressure. In employing such a hybrid e.g., a combination of light and then pressure activated stress relief fixing system, substantially lower energy levels may be employed that is found in conventional pressure fix systems and in addition the solvent vapor step with its accompanying drawbacks is eliminated as found in other hybrid systems. Although pressure followed by light exposure may be employed to obtain satisfactory fixing the sequence of light exposure followed by application of pressure yield more desirable results. Photo fixing has certain advantages to normal heat fusing among which are the utilization of lower energy requirements, less fire hazard in electrophotographic imaging machines and the possibility of employing less complicated types of paper stocks. Polymer degradation may, therefore, be employed of the free radical type which involves decomposition by random chain scissions as well as depolymerization to monomer to effect efficient hybrid flash-pressure fixing. This system is limited to random scissions with quantum efficiencies $\leq 35$. The present photo-oxidant process is ionic and depolymerization to monomer occurs with higher quantum efficiency. This process may either be accomplished by providing a toner material wherein a solvent which effects the stress relaxation is formed in situ by photochemical process or alternatively a photodegradable polymer is allowed to degrade to lower "mers" which will simultaneously lower the viscosity and plasticize undegraded polymer thereby enhancing fixability in the hybrid fixing mode.

DETAILED DESCRIPTION

The present toner system comprises a degradable polymeric composition containing segments characterized by the formula:

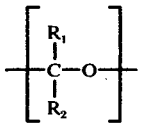

wherein $R_1$ is hydrogen or methyl and $R_2$ is hydrogen, an alkyl radical of 1 to 6 carbon atoms or a cyano substituted radical of 1 to 5 carbon atoms provided that when $R_1$ is methyl, $R_2$ is also methyl, and a photo-oxidant which upon activation is capable of abstracting one or more electrons from one or more of the oxygen atoms in said polymer.

Polymers which can be used in the present invention include those compositions which are prepared by the polymerization of aldehydes to give polymers which correspond to the formula above described.

When aldehydes which contain alkyl groups of 1 to 6 carbon atoms attached to the carbonyl carbon atoms are polymerized, polymers result in which the $R_2$ moiety corresponds to the alkyl group of the aldehyde. Examples of aldehydes which contain such moieties include acetaldehyde, propionaldehyde, n-butyraldehyde, isobutyraldehyde, valeraldehyde, and heptaldehyde.

Alternatively, the aldehyde may contain a chlorinated or fluorinated hydrocarbon radical of from 1 to 6 carbon atoms to provide a polyaldehyde in which the R moiety corresponds to the group attached to the carbonyl carbon of the aldehyde. Examples of such aldehydes include chloroacetaldehyde, dichloroacetaldehyde, chloropropionaldehyde, chlorobutyraldehyde, chloropentaldehyde, chlorovaleraldehyde, chloroheptaldehyde, trifluoroacetaldehyde, trifluoropropionaldehyde, heptalfluorobutyraldehyde, chlorodifluoroacetaldehyde and fluoroheptaldehyde.

In addition, aldehydes which contain cyano substituted hydrocarbon radicals containing from 1 to 5 atoms attached to the carbonyl carbon atoms can be polymerized to form degradable polymers useful in the process of the present invention. Examples of these aldehydes include cyanoacetaldehyde, beta-cyanopropionaldehyde, cyanopentaldehyde and cyanovaleraldehyde.

While ketones are not normally thought of as being polymerizable, poly(acetone) has been reported in the literature by V. A. Kargin, et al. in Dokl. Akad. Navk. SSSR, 134, 1098 (1960), and can be degraded by the action of photo-oxidants in a manner similar to polyaldehydes. Thus, polymers corresponding the foregoing formula in which both $R_1$ and $R_2$ are methyl may be used. Such would not be the case in systems in which the polymer is degraded by a hydrogen abstraction process since the abstracted hydrogen must be directly on the polymer backbone.

When homopolymers of the above-described carbonyl compounds are used, the degradable polymer can be represented by the formula:

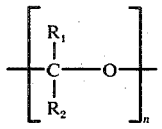

wherein $R_1$ and $R_2$ are as defined above and $n$ is a number representing the degree of polymerization. The degree of polymerization of the homopolymer, i.e., $n$, must be sufficient to provide enough solvent in situ or mers upon depolymerization to effect the process described above. The maximum degree of polymerization is not critical and may be as high as the realities of polymerization of the carbonyl compound permit. In general, those polyether compounds characterized by the foregoing formula in which $n$ is a number within the range of from 50 to 50,000 are preferred for use in the present invention.

In addition to homopolymers of the above-described carbonyl compounds, copolymers and block copolymers containing degradable segments characterized by the foregoing formula can be employed. For example, copolymers and block copolymers may be prepared from one or more of the carbonyl compounds previously described and other polymerizable constituents such as styrene, isoprene, $\alpha$-methylstyrene, methylmethacrylate, phenyl isocyanate and ethyl isocyanate. In addition, the degradable segments may occur as side chains appended from the backbone of another polymer.

The degradable polymer is combined with a photosensitizer which is capable upon exposure to activating radiation of abstracting an electron from one or more of the oxygen atoms in the polymer backbone. Suitable photo-oxidants include pyrylium salts, e.g., 2,4,6-triphenyl pyrylium tetrafluoroborate and 2,4,6-tritolylpyrylium tetrafluoroborate; anthracene and derivatives, e.g., 9,10-dycyanoanthracene; diazonium salts, e.g., diethylaminobenzene diazonium tetrafluoroborate; diethylaminobenzene diazonium zinc chloride; unsaturated anhydrides, e.g., maleic anhydride, chloromaleic anhydride and pyromelletic dianhydride; bipyridylium salts, e.g. 1,1'-dimethyl-4,4'-bipyridylium dichloride; tosylate salts, e.g., tetraethylammonium-p-toluene sulfonate and diaza heterocyclic compounds, e.g., pyridazine; 9,10-diazaphenanthrene; 1,2-diazanaphthalene; 5,10-diazanthracene; 1, 2:3, 4:6, 7-tribenzophenazine; 1,4 diazanaphthalene and 5, 6:7, 8-dibenzoquinoxaline.

In addition certain dyes and colorants listed in the *Colour Index*, vol. 4 and 5 of The Society of Dyers and Colourists American Association of Chemists and Colorists may be used as the photo-oxidant. Exemplary of these materials are hydroxy phthaleins, e.g., Rose Bengal, Phloxine, Phloxine B, Erythrosin B, Erythosine, Fluorescein, Eosine and Dibromoeosine; Acridines, e.g., Acriflavin and Acridine Orange R; Thiazines, e.g., Methylene Blue; Rodamines, e.g., Rodamine B and Rhodamine 6G; Monoazo dyes, e.g., Methyl Orange and Triarylmethane dyes (diamino and triamino derivatives), e.g., Brilliant Green and Methyl Violet.

In addition, natural organic sensitizers such as chlorophyl, riboflavin, and hematoporphrins may be used in the present invention.

The toners of the present invention are prepared by mixing the degradable polymer and photo-oxidant in a suitable solvent. The amount of oxidant used may vary widely provided that at least an effective amount is employed. An effective amount, as used herein, is defined as that amount of photo-oxidant which will cause the rate of degradation of the polymer to increase to a noticeable extent over the rate at which the polymer containing no photo-oxidant will degrade. The maximum amount will normally be determined by the compatibility of the polymer and the photo-oxidant since at very high levels excess photo-oxidant will tend to crystallize out. In general, the photosensitizer will account for from 0.01 to 10 weight percent of the polymer with an amount of from 0.5 to 1.0 weight percent being preferred.

While the present invention is not predicated upon any particular theory or mechanism of operation, it is believed that the following explanation wherein the degradable polymer is poly(acetaldehyde) and the photo-oxidant is designated as P accounts for the observed phenomena.

1. Activating radiation leads to an excited state of the photo-oxidant.

$$P \xrightarrow{h\mu} P^*$$

2. An oxonium ion is formed via electron transfer.

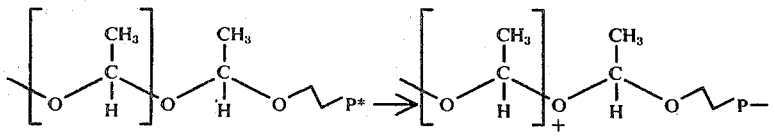

3. Electron shift and chain cleavage converts the oxonium ion into a carbonium ion and an oxy radical.

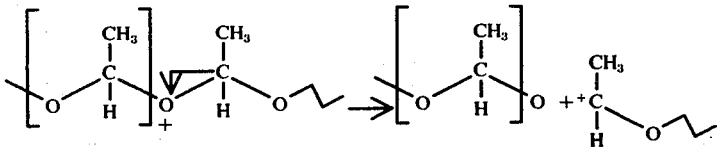

4. The carbonium ion undergoes degradation.

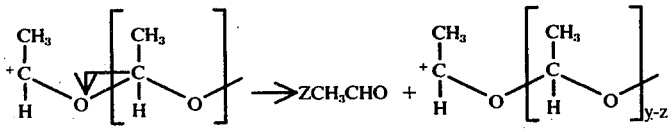

The oxy radical formed may have several fates.

A radical abstraction reaction may occur leading to a hemiacetal end-capped polymer fragment and a radical fragment. The end-capped fragment is relatively stable and no further depolymerization will occur. The radical fragment may be involved in an electron transfer to ground state photo-oxidant leading to further depolymerization.

Suitable degradable polymers for use in the toner system of the instant invention can be prepared by the polymerization of aldehydes to give polymers which correspond to the formula previously set out. When aldehydes which contain alkyl groups of 1 to 6 carbon atoms attached to the carbonyl carbon atom are polymerized, polymers result in which the R moiety corresponds to the alkyl group of the aldehyde. Examples of aldehydes which contain such moieties include acetaldehyde, propionaldehyde, n-butyraldehyde, isobutyraldehyde, valeraldehyde and heptaldehyde. The R moiety may also be hydrogen as is the case with poly(formaldehyde).

Alternatively, the aldehyde may contain a chlorinated or fluorinated hydrocarbon radical of from 1 to 6 carbon atoms to provide a polyaldehyde in which the R moiety corresponds to the group attached to the carbonyl carbon of the aldehyde. Examples of such aldehydes include chloroacetaldehyde, dichloroacetaldehyde, chloropropionaldehyde, chlorobutyraldehyde, chlorovaleraldehyde, chloroheptaldehyde, trifluoroacetaldehyde, trifluoropropionaldehyde, chlorodifluoroacetaldehyde and fluoroheptaldehyde.

In addition, aldehydes which contain cyano substituted aliphatic hydrocarbon radicals containing from 1 to 5 carbon atoms attached to the carbonyl carbon can be polymerized to form degradable polymers useful in the process of the instant invention. Examples of these aldehydes include cyanoacetaldehyde, beta-cyanopropionaldehyde and 5-cyanopentaldehyde.

The relative concentrations of degradable polymer, halogenated polymer and photoactive agent may vary widely. The degradable polymer is employed in an effective amount, i.e., that amount which when degraded will produce sufficient stress relaxation to allow fixing of the toner. Preferably, the degradable polymer will make up from 1 to 49 weight percent of the composition. The photoactive agent should be present in an effective amount, i.e., that amount which will increase the rate of degradation of the degradable polymer to a noticeable extent. A preferred concentration of photoactive agent is from 0.01 to 5 weight percent of the composition. Larger amounts can be used but are not preferred for economic reasons. In addition, too large a concentration of photoactive reagent will result in phase separation due to its crystallization. The balance of the composition is made up of the halogenated polymer and optionally additional elements which do not destroy the basic and novel characteristics of the composition.

As used herein, activating radiation is intended to refer to electromagnetic radiation of a wavelength which will excite the photo-oxidant from the ground state to its excited state. The wavelength of radiation which will cause such excitation will vary with the photo-oxidant being used. In general, photo-oxidants useful in the present invention are activated by electromagnetic radiation in the ultraviolet, near ultraviolet or visible regions of the spectrum. When 2,4,6-tri-p-tolylpyrylium tetrafluoroborate is employed as the photo-oxidant, irradiation in the ultraviolet range is employed with UV visible light having wavelengths of 200 nm to 500 nm or 420 nm being preferred.

The exposure time necessary for sufficient polymer degradation will vary depending upon the relative concentrations of degradable polymer and photo-oxidant in the film, the intensity and wavelength of the activating radiation, the thickness of the film and properties of the substrate. Thus, the optimum exposure time for a given toner in order to achieve the desired amount of degradation may require some routine experimentation, but would in no way require the application of inventive skill. Typically, a period of exposure between 10 and 600 seconds will be sufficient for purposes of practicing the invention although longer and shorter exposure times may be appropriate in some instances.

In general irradiation at a minimim of 0.1 watt-sec/cm$^2$ should be employed, while irradiation sufficient to provide a 0.5 watt-sec/cm$^2$ is found to perform satisfactorily. If one were to employ a conventional P.E.K., Inc. 100 watt high pressure compact point source mercury arc, at least a 5 second exposure would be required. If a conventional Xenon Corporation flash lamp such as the Novatron 213-A were to be employed and operated at a 300 watt input with pulses having $10^{-5}$–$10^{-4}$ second pulse durations, the necessary exposure energy could occur in $10^{-3}$ second total exposure time.

It is found that the degree of fix obtained for these toner materials is related to light exposure, sensitizer loading carbon black distributions and toner particles (ability to absorb light for a flash fusing) and pressure roll speeds.

The photodegradable polymeric material as described above is admixed with a suitable colorant such as, for example, carbon black and a suitable electrophotographic resin especially when this toner material is to be employed in a multiphase form as in an encapsulated toner composition to provide a toner material. Thus the toner could be fabricated of photodegradable polymer which would pressure fix and subsequently partially photodegrade giving the hybrid fix desired or it could be employed in a combination, for example styrene/alkylmethacrylate compositions etc. In the case of encapsulated toners and other multiphase toners the weight % of photodegradable polymer based on the total weight of composition is from 1 to 49. When polymers are combined, the criterion for the monomer obtained through photodegradation would be that it relaxes the stressed photolytically inert matrix polymer for example, by solvolysis, plasticization, or other mechanistic means. Thus, for example, a toner material comprising polystyrene encapsulated polyacetaldehyde, maleic anhydride and a carbon black colorant may be provided by conventional spray drying techniques to provide toner particles having a diameter of for example, 15 to 20 microns on the average having dispersed therein smaller domains of polyacetaldehyde for example 0.5 microns diameter and carbon black. This toner material may then be mixed with a conventional carrier and applied to an electrostatic latent image formed through a conventional process including the steps charging an electrophotographic member and exposing said member. The resulting visible image may then be fixed by a hybrid fixing step including the steps of applying pressure followed by application of activating radiation resulting in the properly fixed image.

The following examples are given to aid in understanding the invention, but it is to be understood that the invention is not restricted to the particular times, proportions, components and other details of the examples.

EXAMPLE I

A toner material is prepared by spray drying the following composition: 9.5 grams polystyrene, 0.5 grams poly-(dichloroacetaldehyde), 0.5 grams carbon black, 0.005 grams maleic anhydride and 500 milliliters of a 2:3 volume ratio of chloroform and hexane. The carbon black is dispersed and wetted in the chloroform solvent 24 hours prior to spray drying. Polystyrene, maleic anhydride, and poly(dichloroacetaldehyde) are dissolved in chloroform blended with the carbon black solution and finally hexane is added just before spray drying. The largest particles obtained are found to be about 20 microns in diameter. The carbon black is encapsulated in the polystyrene matrix. A conventional carrier is added and the resulting developer is then employed in the conventional electrophotographic process by applying the same to a latent electrostatic image followed by application of light and then pressure resulting in an appropriately fixed electrophotographic image. The hybrid fixing is accomplished by subjecting the toner image to a flash from a high energy flash lamp (213A-Xenon Corporation), positioned at the foci of specially designed parabolic reflector operated at 350 joules maximum input having a rise time of 0.3u sec. and a pulse duration (½ peak height width) of 10–100u sec., delivering to the paper toner surface a light intensity of $6\times10^6$ erg/cm$^2$/flash followed immediately by pressure fixing at 400 pli at 10 inches per sec.

EXAMPLE II

Example I is again performed with the exception that two light flashes are employed.

EXAMPLE III

The procedure as outlined in Example I is again performed with the exception that the pressure fixing is performed at 5 inches per sec. and 400 pli.

EXAMPLE IV

The procedure as outlined in Example I is again performed with the exception that a hybrid fixing sequence of pressure applied at 400 pli at 5 inches per sec. followed by 1-flash is employed.

EXAMPLE V

The procedure as outlined in Example IV is again performed with the exception of the light exposure step employs 2-flashes.

EXAMPLE VI

Poly(acetaldehyde) is prepared by polymerizing acetaldehyde monomer cationically at −100° C in liquid ethylene using BF3- etherate as an initiater. The polymer is reacted immediately with acetic anhydride in the presence of pyridine to convert the hemi-acetal end groups to acetate end groups. The end-capped polymer is precipitated three times in distilled water, redissolved in benzene, dryed over anhydrous magnesium sulphate and then freeze dried. The polymer molecular weight $\overline{M}w$=500,000 is subsequently stored in amber bottles at −20° C. This polymer along with polystyrene having an $\overline{M}w$=39,000, $\overline{M}n$=7,000, and MWD–5.57 and Tg of 68°–70° C is dissolved in a chlorobenzene solvent and this solvent-solute system is directed through a 23–26 gauge hypodermic needle at variable feed rates upon an air driven rotating desk whose velocity is controlled by air pressure. The solute-solvent system is instantly converted into an aerosol and upon solvent evaporation solid spherical particles result. A toner material including 10.35 grams of polystyrene, 1.15 grams of polyacetaldehyde produced above and diethylamino benzene diazonium tetra fluoroborate at 0.18 grams is spray-dried from 250 milliliters of chlorobenzene at 40° C. This mixture is redissolved in chlorobenzene with 0.14 black colorant thoroughly dispersed and then spray dried to form toner. This material is loaded at 1% by weight onto a conventional carrier and ball milled at room temperature for 4 hours. The toner material is then applied to an electrostatic latent image to form a visible toner image. The toner image is pressure fixed at 400 pli at a roller speed 10 inches per sec. followed by illumination at 200 J from a Xenon lamp flash at a distance of 2 inches followed by a 200 J flash (Stroboflash 4) at 1 inch. Acceptable but not high quality fix is obtained.

EXAMPLE VII

The procedure as outlined in Example VI is again performed with the exception that the pressure and flash exposure sequence is reversed so that flash exposure is employed followed by pressure fixing. Noticeably better fixing is obtained than observed in Example VI.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize or otherwise desirably affect the properties of the systems of their present use.

Anyone skilled in the art will have other modifications occur to him based on the teachings of the present invention. These modifications are intended to be encompassed within the scope of this invention.

What is claimed is:

1. A toner comprising a colorant and a photodegradable polymer containing segments satisfying the formula:

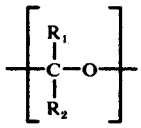

wherein $R_1$ is hydrogen or methyl and $R_2$ is hydrogen, an alkyl radical of 1 to 6 carbon atoms, a chlorinated or fluorinated aliphatic radical of 1 to 6 carbon atoms or a cyano substituted radical of 1 to 5 carbon atoms provided that when $R_1$ is methyl $R_2$ is also methyl, and a photo-oxidant which upon activation by exposure to a degradable amount of activating radiation is capable of abstracting one or more electrons from one or more of the oxygen atoms in said polymer.

2. The toner as defined in claim 1 wherein the segment is selected from the group consisting of acetaldehyde, propionaldehyde, n-butyraldehyde, isobutyraldehyde, valeraldehyde, and heptaldehyde.

3. The toner as defined in claim 1 wherein said segment is selected from the group consisting of chloroacetaldehyde, dichloroacetaldehyde, chloropropionaldehyde, chlorobutyraldehyde, chlorovaleraldehyde, chloroheptaldehyde, trifluoroacetaldehyde, trifluoropropionaldehyde, chlorodifluoroacetaldehyde and fluoroheptaldehyde.

4. The toner as defined in claim 1 wherein said segment is selected from the group consisting of cyanoacetaldehyde, beta-cyanopropionaldehyde and 5-cyanopentaldehyde.

5. The toner as defined in claim 1 wherein said photo-oxidant reagent is a compound selected from the group consisting of pyrylium salts, anthracene and derivatives thereof, diazonium salts, unsaturated anhydrides, bipyridylium salts, tosylate salts, and diaza heterocyclic compounds.

6. The toner as defined in claim 5 wherein the photo-oxidant reagent is present in an amount from 0.01 to 5 weight percent of the composition.

7. The toner as defined in claim 1 wherein said photo-oxidant reagent is maleic anhydride.

8. The toner as defined in claim 1 further comprising a carrier.

9. An improved electrophotographic fixing process comprising the steps of providing a photoconductive insulating layer, selectively exposing said layer to form a latent electrostatic image, developing said image and fixing said image, the improvement which comprises employing a photodegradable polymeric toner comprising a colorant and a photodegradable polymer containing segments satisfying the formula:

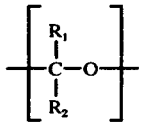

wherein $R_1$ is hydrogen or methyl and $R_2$ is hydrogen, an alkyl radical of 1 to 6 carbon atoms, a chlorinated or fluorinated aliphatic radical of 1 to 6 carbon atoms, or a cyano substituted radical of 1 to 5 carbon atoms provided that when $R_1$ is methyl $R_2$ is also methyl, and a photo-oxidant which upon activation is capable of abstracting one or more electrons from one or more of the oxygen atoms in said polymer, during said developing step and employing exposure to light to photodegrade said photodegradable polymer and the application of pressure to said polymeric toner image during said fixing step.

10. The process as defined in claim 9 wherein said fixing step is performed by first exposing to light and then applying pressure.

11. The process as defined in claim 9 wherein said fixing is accomplished by first applying pressure and then exposing to light.

12. The process as defined in claim 9 wherein said photo-oxidant comprises a compound selected from the group consisting of pyrylium salts, anthracene and derivatives thereof, diazonium salts, unsaturated anhydrides, bipyridylium salts, tosylate salts, and diaza heterocyclic compounds.

* * * * *